United States Patent [19]

Redmond et al.

[11] 4,392,658

[45] Jul. 12, 1983

[54] SKATE BLADE

[75] Inventors: Harry W. Redmond; Raymond V. Jeannotte, both of Langley, Canada

[73] Assignee: Norjay Services, Ltd., Langley, Canada

[21] Appl. No.: 213,228

[22] Filed: Dec. 5, 1980

[51] Int. Cl.[3] ..... A63C 1/30

[52] U.S. Cl. ..... 280/11.18

[58] Field of Search ..... 280/11.12, 11.15, 11.18, 280/608, 609; 51/228, 206 R, DIG. 74; 76/83

[56] References Cited

U.S. PATENT DOCUMENTS

| | | | |
|---|---|---|---|
| 60,431 | 12/1866 | Scott et al. | 280/11.18 |
| 83,339 | 10/1868 | Thurston | 280/11.12 |
| 750,696 | 1/1904 | Price | 76/83 |
| 1,100,976 | 6/1914 | Hille | 280/11.18 |
| 4,114,913 | 9/1978 | Newell et al. | 280/12 H |

FOREIGN PATENT DOCUMENTS

| | | | |
|---|---|---|---|
| 41185 | 10/1887 | Fed. Rep. of Germany | 280/11.18 |
| 2042462 | 3/1972 | Fed. Rep. of Germany . | |

*Primary Examiner*—David M. Mitchell

*Assistant Examiner*—Kenneth R. Rice

*Attorney, Agent, or Firm*—Klarquist, Sparkman, Campbell, Leigh, Whinston & Dellett

[57] ABSTRACT

An elongated skate blade for an ice skate, the blade including first and second acute-angled cutting edges formed longitudinally on opposed sides of the blade for cutting engagement with an ice surface, and a generally downwardly facing longitudinally extending bottom surface extending transversely from the first cutting edge to the second cutting edge. The bottom surface includes first and second longitudinally extending edge faces rising upwardly and inwardly from the first and second cutting edges respectively, and a longitudinally extending middle face centrally disposed between the first and second edge faces. The middle face has a substantially flat or downwardly convex profile in transverse cross-section for at least one-third of the distance from the transverse center of the blade to each side of the blade. Where the middle face is downwardly convex, the radius of curvature exceeds the width of the blade for at least one-third of the distance from the transverse center of the blade to each side of the blade.

34 Claims, 7 Drawing Figures

SKATE BLADE

The present invention relates to skate blades for ice skates, particularly to the profile of the bottom surface thereof.

Over the years, there appears to have been relatively little evolution in the accepted design of skate blades for single runner ice skates. Generally speaking, skaters tend to prefer one of two types of designs depending on the particular activity in which they are engaged. For example, speed skaters tend to prefer blades which have a substantially flat bottom surface to minimize gliding friction with the ice and thereby enhance speed. On the other hand, skaters such as hockey players tend to prefer blades which have a "hollow ground" profile where the bottom face of the blade has a concave transverse cross-section extending widthwise between cutting edges formed on either side of the blade. With a hollow ground profile, the cutting edges of the blade constantly bite into the ice surface thereby enhancing the ability of the skater to maneuver. However, the enhanced maneuverability is achieved with the sacrifice of speed and the effort required to stay in motion. The preferred degree of concavity in a hollow ground blade may vary from one player to the next depending upon skating skill and the tradeoff each makes as between speed and maneuverability.

The foregoing is not to say that other blade designs have not been suggested or devised. In relation to the invention to be described hereinafter, a design which is of interest is that described in U.S. Pat. No. 1,100,976 granted to Hille on June 23, 1914. Hille teaches a structure which comprises three parts—a central blade having a rounded edge (for smooth travel on an ice surface); and two bevelled side blades, one on each side of the central blade and each having a cutting edge for cutting engagement with an ice surface. Hille contemplates that the side blades are adjustable relative to the central blade thus enabling adjustment for "speed skating" or for "fancy skating". He indicates that when the side blades are adjusted to their "upper limit" with the cutting edges slightly above the "lower edges of the blade", then the skate is adjusted for speed skating. When the skate is adjusted for speed skating, Hille indicates that the rounded surface of the central blade will travel on the ice surface, but, at the same time, the side blades are low enough so that when the skater inclines his foot slightly, the sharp edges of those blades will engage the ice. For "fancy skating", Hille contemplates that the side blades are adjusted to a "lower limit" where the cutting edges of the side blades are below the bottom of the rounded central blade.

However, there are drawbacks to the design contemplated by Hille. His teachings are limited to an "either-/or" situation-viz. either "speed skating" or "fancy skating". This fails to acknowledge the interests of skaters such as hockey players who are interested in both speed and maneuverability. One might speculate that since Hille's design has an "upper limit" of adjustment for speed skating and a "lower limit" of adjustment for "fancy skating", then it is reasonable to suppose an "intermediate" position of adjustment where at the sacrifice of some speed there is increased maneuverability and at the sacrifice of some maneuverability there is increased speed. However, this is not so or is not satisfactorily so, especially if one fails to take into account the dependency of performance on the relationship between ice engaging surfaces and edges.

In the specific design taught by Hille, each side blade has a width about the same as the width of the central blade, and the transverse profile of the bottom surface of the central blade is highly convex-sweeping a circular arc that approaches 180°. The radius of curvature of the profile is about one-sixth of the overall width of the three part blade taken between the cutting edges. The transverse distance from either cutting edge to a point of tangency with the rounded bottom is relatively far (approaching one-half the overall width) regardless of the position at which the side blades are adjusted. This design has been found to be undesirable not only because skating on the highly rounded surface of the central blade can be inherently unstable, but also because the cutting edges of the side blades tend to engage the ice surface in an abrupt and difficult to control manner when the skate is tilted.

The present invention seeks to provide a new and improved skate blade which enables improved maneuverability, stability and control without an undue sacrifice of speed or the effort required to stay in motion.

In accordance with a broad aspect of the present invention there is provided an elongated skate blade for an ice skate, the blade including first and second acute-angled cutting edges formed longitudinally on opposed sides of the blade for cutting engagement with an ice surface, and a generally downwardly facing longitudinally extending bottom surface extending transversely from the first cutting edge to the second cutting edge. The bottom surface includes first and second longitudinally extending edge faces rising upwardly and inwardly from the first and second cutting edges respectively, and a longitudinally extending middle face centrally disposed between the first and second edge faces. The middle face has a substantially flat or downwardly convex profile in transverse cross-section for at least one-third and preferably at least one-half of the distance from the transverse centre of the blade to each side of the blade (viz. a central part of the middle face is substantially flat or downwardly convex in transverse cross-section for at least one-third and preferably at least one-half of the overall width of the blade). In cases where the profile is downwardly convex, the radius of curvature exceeds the width of the blade at all points of the profile for at least one-third and preferably at least one-half of the distance from the transverse centre of the blade to each side of the blade. This limitation contemplates a relatively small amount of convex curvature at most.

Herein, and in the claims, the words "radius of curvature" are not to be taken in the sense of meaning or implying restriction to a constant or substantially constant radius of curvature. As is well known, any curve at a given point on the curve has a "radius of curvature", but the radius may vary from one point to the next unless the curve is uniform as in the case of a circle or a circular arc. Accordingly, where it is expressed herein that a radius of curvature of a given profile exceeds a limiting value, it is to be understood that the radius may be constant or variable provided it always exceeds the limit. It may be observed that a substantially flat profile can be regarded as a "curve", the radius of curvature of which is equal to or approaching infinity.

Preferably, the first and second edge faces have a downwardly concave profile in transverse cross-section. This improves the tendency of the edges to shave rather than gouge into the ice surface during stops and turns.

Whether the middle face has a substantially flat profile or a downwardly convex profile in transverse cross-section will tend to be a matter of individual preference. In any case, the middle face provides a relatively wide ice engaging surface between the cutting edges thereby contributing to maximum speed while minimizing the effort required to stay in motion. Further, the relatively wide surface advantageously limits the depth the blade will cut into the ice during heavy turns or pivots.

The level of the substantially flat or downwardly convex profile may be above, or approximately level with, or below the level of the cutting edges of the blade. Again, this will tend to be a matter of individual preference. Ultimately, however, it is considered that the most advantage can be gained from the present invention where the level of the substantially flat or downwardly convex profile resides below the level of the cutting edges. As the level rises above the level of the cutting edges, the "feel" of the blade will begin to more closely approximate that of a conventional hollow ground blade because the cutting edges will be in constant engagement with the ice. There will be some adverse impact on speed, but it will not be as serious as that which would be associated with a hollow ground blade having similar geometry in transverse cross-section at and near the cutting edges of the blade. As the level drops below the level of the cutting edges, the "feel" of the blade departs more and more from that of a hollow ground blade. For some skaters this may be disconcerting. Depending upon the extent to which their existing skating style has been ingrained, they may prefer to maintain the level of the substantially flat or downwardly convex profile above the level of the cutting edges or they may prefer to gradually progress from a design in which the level is above to a design in which the level is below.

In accordance with a preferred embodiment of the present invention, an elongated skate blade has first and second acute-angled cutting edges formed longitudinally on opposed sides of the blade for cutting engagement with an ice surface when the blade is laterally tilted in one direction or the other from an upright attitude on the ice surface. The blade includes a generally downwardly facing longitudinally extending bottom surface which extends transversely from the first cutting edge to the second cutting edge. The bottom surface comprises first and second longitudinally extending edge faces which rise upwardly and inwardly from the first and second cutting edges respectively, and a downwardly protruding longitudinally extending middle face centrally disposed between the first and second edges for providing sliding engagement with the ice surface. The middle face has a transverse cross-sectional profile such that the length of tangent lines extending transversely inwardly and downwardly from the first and second cutting edges to points of tangency with the middle face are not more than one-third of the width of the blade. Preferably, the length of the tangent lines is not less than one-eighth and not more than one-quarter of the width of the blade.

As will become more clearly apparent hereinafter, the limitations on the length of tangent lines dictates a relatively wide ice engaging surface between the cutting edges which (as is discussed above) contributes to maximum speed with minimum effort required to stay in motion, and limits the depth the blade will cut into the ice surface during heavy turns or pivots. By restricting the upper limit of the tangent lines to not more than one-third and preferably not more than one-quarter of the width of the blade, it has been found that the tendency which the blade may otherwise have to gouge into the ice surface during turns and pivots is advantageously reduced. The lower limit of one-eighth of the width of the blade on the length of the tangent lines is preferred in order to reduce the tendency of the blade to slip on turns and pivots, and because difficulty may be encountered with the grinding of a blade having a shorter tangent line.

The transverse cross-sectional profile of the downwardly protruding middle face may vary within the scope of the present invention and be quite dependent on individual preferences. For example, it may have a downwardly convex profile or the profile may include a substantially flat central portion. In one embodiment which has been found to be particularly desirable by at least some skaters, the profile is such that the middle face effectively presents two longitudinally extending shoulders with a relatively wide longitudinally extending central portion extending transversely between the shoulders. The profile may curve upwardly and outwardly relatively steeply at such shoulders with varying degrees of curvature. Experience to date has indicated that very sharp shoulders are less likely to be preferred over shoulders which, while relatively well defined, could not be said to be "sharp". Experience to date has also indicated that a slight degree of convex rounding on the central portion of the middle face between the shoulders is likely to be preferred over a central portion which is substantially flat. However, as indicated above, individual preferences may very well differ. Conceivably, it is possible that some skaters may want a very slight amount of hollow grinding on the central portion between the shoulders—not to the degree that would be found on a conventional hollow ground blade (because that would entirely defeat the purpose of the present invention), but to a degree that would give a very slight amount of "edge" to the middle face while still enabling the middle face to provide substantially smooth slidingly engagement with an ice surface.

Although the level of the cutting edges above the bottom of a downwardly protruding middle face will be a matter of individual preference, the level should not be too high. Otherwise, the amount of lateral tilting required to cause engagement between a cutting edge and an ice surface will be excessive with a resulting loss of control and manoeuverability. To avoid a requirement for excessive lateral tilting, it is considered that the tangent lines should extend downwardly from the cutting edges at an angle of not more than 20° relative to the horizontal. Even a 20° angle is high, and it is believed that the majority of skaters will prefer tangent angles within the range of 1° to 10°, the better skaters selecting angles toward the higher end of the range. Angles towards the lower end of the range would be most suited for relatively poor skaters or learners, or those who insist on having some cutting edge in contact with the ice at all times.

The present invention does not require that the bottom surface of the blade have a symmetric profile transverse to the longitudinal axis of the blade. This is not considered to be essential, and it is in fact contemplated that at least some skaters may prefer slightly different characteristics on the inside cutting edge of a blade than on the outside cutting edge of a blade. For example, where the middle face of the blade protrudes downwardly below the level of the cutting edges, a skater may prefer to have the inside cutting edge engage the ice surface with less tilt of the blade than is required to have the outside cutting edge engage the ice surface. However, it is also believed that such preferences will likely be the mark of highly skilled and demanding skaters. For purposes of repetitive manufacture and interchangability, it is considered that a substantially symmetric profile will be preferred and will satisfactorily meet the expectations of most skaters.

A skate blade in accordance with the present invention may be manufactured with the use of a circular grindstone, the grindstone having a grinding edge dressed with a profile opposite to the desired transverse cross-sectional profile of the bottom surface of the blade.

The invention will now be described in more detail with reference to the drawings.

Figure 1:
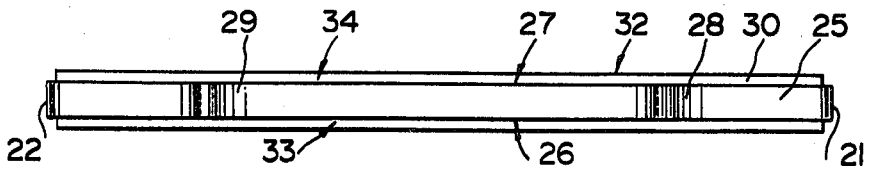
FIG. 1 is a top view of a skate blade in accordance with the present invention.
Figure 2:
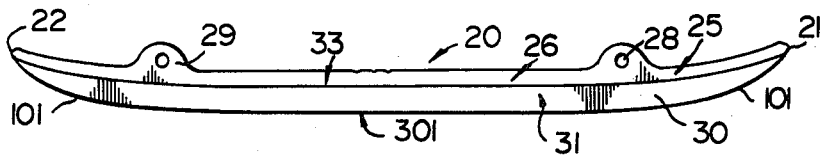
FIG. 2 is a side elevation view of the skate blade shown in FIG. 1.
Figure 3:
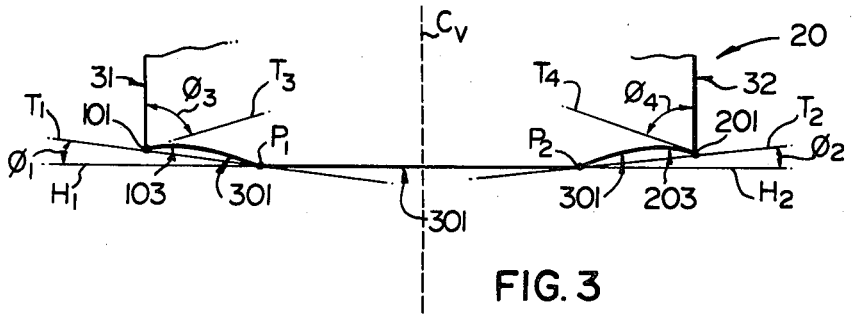
FIG. 3 is a transverse cross-sectional view of the lower portion of the skate blade shown in FIG. 1.

The skate blade (generally designated 20) shown in FIGS. 1 to 3 is typical of a blade that might be used by a hockey player. The side elevation view shown in FIG. 2 is approximately to scale in both length and height. The cross-sectional detail shown in FIG. 3 is approximately to scale in width and in height (insofar as height portions are not cut-away). Of course, the scale in FIG. 3 is much greater than the scale in FIG. 2. In the case of FIG. 1, the width has been exaggerated relative to the length. By way of representative example, the overall length of the blade (measured from tip 21 to tail 22) may be of the order of 12 inches, and the overall width of the blade (measured between sides 31 and 32) may be of the order of 0.10 inches to 0.25 inches.

Blade 20 is an integral piece which may be formed from various suitable materials, for example, AISI #440C stainless steel. Longitudinally, it has a conventional overall extension and curvature. The blade comprises an upper body portion generally designated 25 and a lower body portion generally designated 30, the upper body portion being inwardly stepped relative to the lower body portion and including two apertured mounting flanges 28, 29 to facilitate bolting attachment in a conventional blade holding bracket (not shown) of a conventional skate boot (also not shown). Upper body portion 25 slides upwardly into the blade holding bracket until upper faces 33 and 34 of lower body portion 30 abut corresponding lower faces of the bracket. At the same time, the apertures of flanges 28, 29 are aligned with corresponding apertures in the blade holding bracket thereby permitting the blade to be secured to the bracket by a pair of bolts (not shown).

Skate blade 20 includes a first acute-angled cutting edge 101 formed longitudinally on one side of the blade and a second acute-angled cutting edge 201 formed longitudinally on the opposite side of the blade. The blade includes a downwardly protruding longitudinally extending middle face 301. As may best be seen in FIG. 3, middle face 301 merges transversely with first and second edge faces 103 and 203 which extend inwardy and upwardly from the first and second cutting edges 101 and 201, respectively. Cutting edges 101 and 201, middle face 301, and edge faces 103 and 203 extend lengthwise for the entire length of lower body portion 25, and the relationship indicated in FIG. 3 remains substantially uniform for this entire length.

For the purpose of clarifying particular features of the geometry of the lower portion of blade 20, FIG. 3 shows two horizontal lines $H_1$, $H_2$ and two tangent lines $T_1$, $T_2$. The length of tangent line $T_1$ measured from cutting edge 101 to the point of tangency $P_1$ with middle face 301 is about 20% to 21% (viz. less than one-third) of the distance between cutting edges 101 and 201. Similarly, the length of tangent line $T_2$ measured from cutting edge 201 to the point of tangency $P_2$ with middle face 301 is about 20% to 21% of the distance between cutting edges 101 and 201. Tangent line $T_1$ extends downwardly from cutting edge 101 to point $P_1$ at an angle $\phi_1$ of approximately 8° relative to horizontal line $H_1$. Similarly, tangent line $T_2$ extends downwardly from cutting edge 201 to point $P_2$ at an angle $\phi_2$ of approximately 8° relative to horizontal line $H_2$.

It can be seen from FIG. 3 that edge faces 103 and 203 each have a generally concave curvature in transverse cross-sectional profile. Middle face 301 has a generally convex curvature in transverse cross-sectional profile, but the degree of convexity varies across the width of the face. In the region of tangent points $P_1$ and $P_2$, middle face 301 is curving upwardly at a relatively high rate and forms relatively well defined shoulders. Here, the degree of convexity is relatively high. Across the relatively wide central portion of middle face 301 between tangent points $P_1$ and $P_2$, there is only a very slight convex curvature. In the blade from which FIG. 3 was patterned, the lowermost point of middle face 301 was of the order of one-thousandth of an inch below the level of tangent points $P_1$, $P_2$.

FIG. 3 also shows a tangent line $T_3$ which is a line tangent to edge face 103 where it coincides with cutting edge 101, and a tangent line $T_4$ which is a line tangent to edge face 203 where it coincides with cutting edge 201. The acuteness of cutting edge 101 is indicated by angle $\phi_3$ between side 31 and tangent line $T_3$. Similarly, the acuteness of cutting edge 201 is indicated by angle $\phi_4$ between side 32 and tangent line $T_4$.

In use, blade 20 will always depress at least some amount into the ice surface on which it travels. The actual amount is variable and will depend upon a number of factors including not only the design of the blade itself but also external factors such as the weight of the skater and dynamic conditions, temperature, and the hardness of the ice. Since there is some depression, the angle through which the blade must be laterally tilted in order to have an ice cutting edge engage the ice surface will necessarily be less than angle $\phi_1$ if the blade as shown in FIG. 3 is laterally tilted to the left, and less than angle $\phi_2$ if the blade as shown in FIG. 3 is laterally tilted to the right.

One of the effects of dictating that tangent lines $T_1$ and $T_2$ have a length less than one-third (and in this particular case, about 20%) of the transverse distance between cutting edges 101 and 201 is to limit the amount that blade 20 will depress into the ice for a given set of ice conditions and downwardly depressing forces acting on the blade. The reason is that for a given overall blade width the downwardly depressing forces are distributed over a relatively wide area of middle face 301 which protrudes below the level of the cutting edges. Thus, when the blade is maintained in a generally upright attitude on the ice surface, and for a limited degree of lateral tilting from the upright position, cutting edges 101 and 201 will not engage the ice and skating will occur on middle face 301. Such distribution of downwardly depressing forces and the non-engagement of the cutting edges with the ice reduces the level of drag forces which may otherwise occur and which are undesirable for speed skating purposes.

When blade 20 is laterally tilted a sufficient amount, then cutting edge 101 or cutting edge 201 (depending upon the direction of tilt) will cut into the ice and enable the skater to execute sharp turns or to rapidly stop or start. During such maneuvers, it is desirable that the cutting edge shave rather than gouge into the ice. While it has been noted that the tendency of a blade to shave rather than gouge the ice generally improves with shorter tangent lines from the ice cutting edges to the downwardly protruding middle face, it has also been noted that a blade may have a tendency to slip if such tangent lines are too short. With the blade design of FIGS. 1 to 3, it was found that there was neither an undue tendency to slip or an undue tendency to gouge.

Concave edge faces such as edge faces 103 and 203 are also believed to reduce the tendency that a blade may have to gouge into the ice surface, the action between these faces and the ice being more analogous to that of a snowplow which throws rather than pushes scraped material in advance of the face. Further, such concave faces better enable a relatively smooth transverse merger with middle face 301, thereby reducing the chances that ice may pack under the blade between the cutting edges and the lower face.

The design of skate blade 20 is considered to be especially suitable for the type of skating which is required during the game of hockey. Sliding friction on the ice is relatively low when the blade is maintained in a substantially upright position and when the blade is laterally tilted not more than a limited degree from the upright position. When the blade is laterally tilted to the degree that a cutting edge engages the ice, the skater is able to execute sharp turning maneuvers and well controlled starts and stops.

Figure 4:
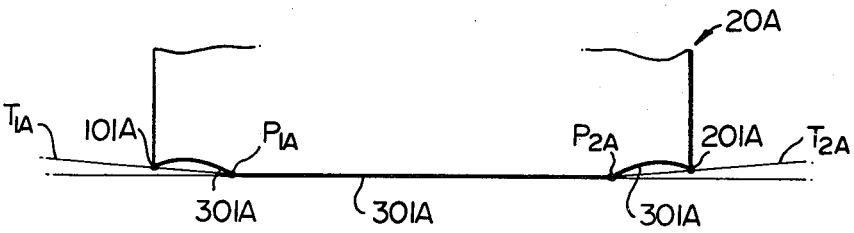
FIG. 4 is a transverse cross-sectional view of the lower portion of another skate blade in accordance with the present invention.

FIG. 4 illustrates a cross-sectional profile of the lower portion of another skate blade 20A which is generally similar to blade 20, but which embodies some differing design details. In the design of blade 20A, downwardly protruding lower face 301A is substantially flat between points of tangency $P_{1A}$ and $P_{2A}$. Also, middle face 301A has relatively steep longitudinally extending shoulders in the region of these points of tangency (viz. relatively sharp in comparison to the longitudinally extending shoulders of blade 20). The length of tangent line $T_{1A}$ and $T_{2A}$ measured from cutting edges 101A and 201A to points of tangency $P_{1A}$ and $P_{2A}$, respectively, is about 15% to 16% of the transverse distance between the cutting edges. In general, the design of blade 20A has been found to perform quite satisfactorily, but with a somewhat increased tendency to slip (in comparison to the blade design of FIGS. 1 to 3) during the execution of maneuvers where the cutting edges engage the ice.

Figure 5:
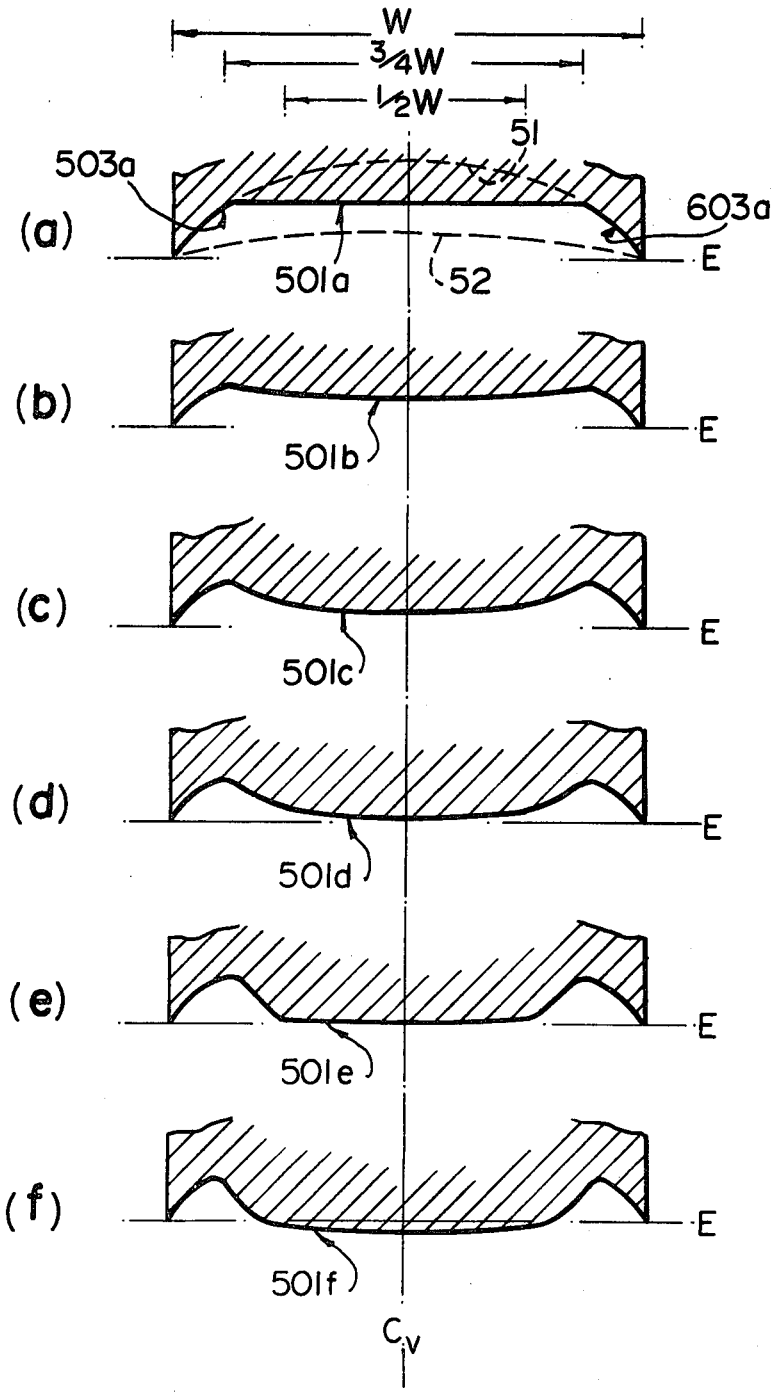
FIG. 5 shows transverse cross-sectional views of the bottom portion of a progression of skate blades in accordance with the present invention.

FIG. 5 shows transverse cross-sectional views of the bottom portion of a progression of skate blades, each having a middle face which is substantially flat or downwardly convex for at least one-half of the distance from the transverse centre $C_v$ of the blade to each side of the blade. For purposes of illustration, each of the blades shown in FIG. 5 are shown as having the same width W. Also, for purposes of illustration, the vertical dimension for each blade in FIG. 5 has been exaggerated relative to the blade width. For each blade in FIG. 5, a horizontal line E indicates the level of the cutting edges. The edge faces of the blades leading upwardly and inwardly from the cutting edges may be considered to have essentially the same cross-sectional profile in each case (viz. a profile which is preferably downwardly concave).

The purpose of FIG. 5 is to show a progression of possible cross-sectional profiles in accordance with the present invention, beginning with the blade design of FIG. 5(*a*) which has a profile that will come closest to the "feel" of a hollow ground blade and ending with the blade design of FIG. 5(*f*) which has a profile similar to that discussed in relation to FIGS. 1 to 4.

In the blade design of FIG. 5(*a*), middle face 501*a* is substantially flat for its entire width which is about three-quarters of the width W of the blade. In this FIGURE, a broken line 51 has been shown as a smooth concave continuation from edge face 503*a* to edge face 603*a*. The overall cross-section defined by line 51 combined with the lines of edge faces 503*a* and 603*a* is representative of a conventional hollow ground blade. Such a hollow ground blade would cause more dragging force for a skater than any one of the blades shown in FIG. 5, including that shown in FIG. 5(*a*). To reduce the amount of the drag, one could adopt a shallower degree of "hollow" as indicated by broken line 52 in FIG. 5(*a*). However, as can be seen, the angles of the cutting edges will become correspondingly less acute. This will have a disadvantageous effect on control and maneuverability. As the degree of the "hollow" in a conventional blade becomes less and less, the profile of the bottom surface of the blade will approach a straight line from one side of the blade to the other.

In the blade design of FIG. 5(*b*), middle face 501*b*, has a slight downwardly convex profile with substantially uniform curvature for the entire width of the face (which is about three-quarters of the width W of the blade). The radius of curvature of the profile (which is necessarily substantially constant in this case) exceeds the the width W of the blade at all points.

In the blade design of FIG. 5(*c*), the profile of middle face 501*c* is downwardly convex as in the case of middle face 501*b*, however the curvature is not uniform and the lowermost portion of middle face 501*c* is lower than the lowermost portion of middle face 501*b*. Middle face 501*c* tends to become more highly curved with distance away from transverse centre line $C_v$. Alternately, it can be said that the radius of curvature of the profile decreases with distance away from centre line $C_v$. However, although the radius of curvature decreases with distance away from the centre line, it nevertheless exceeds the width W of the blade for at least the central one-half portion of the overall width.

The levels of the middle faces in the blade designs of FIGS. 5(*a*), 5(*b*) and 5(*c*) are all above the level E of the corresponding cutting edges in each case. In the blade designs of FIGS. 5(*d*) and 5(*e*), the levels of middle faces (viz. faces 501*d* and 501*e*, respectively) are approximately the same as the level E of the corresponding cutting edges for a substantial portion of the overall width of such middle faces. At this and even slightly lower levels, there will still be some of the characteristics of a hollow ground blade because the cutting edges will normally remain in continuous contact with the ice. However, when the level of the middle is made sufficiently low as represented by middle face 501*f* in FIG. 5(*f*), the cutting edges will not engage the ice surface except when the blade is tilted.

As previously indicated, it is considered that blade designs such as those depicted in FIGS. 1 to 4 or FIG. 5(*f*) are desirable for purposes of achieving the most potential for speed with minimal sacrifice of control and maneuverability. However, as has also been indicated, it is anticipated that some skaters will prefer designs such as those indicated in FIGS. 5(*a*) through 5(*f*) which continue to retain some (though, in general, progressively less) of the characteristics of a conventional hollow ground blade with which they are familiar.

It will be readily apparent to those skilled in the art that a wide variety of blade designs are possible within the scope of the present invention. In any case, it is to be remembered that individual preferences may play a significant role. This is particularly so for highly skilled skaters who, as a general rule, will be much quite sensitive to design variations. In such cases, some experimentation and testing may be required to find the particular cross-sectional profile which is best suited to the style and abilities of the skater. A profile considered ideal by one skater may be considered less than ideal by another.

Figure 6:
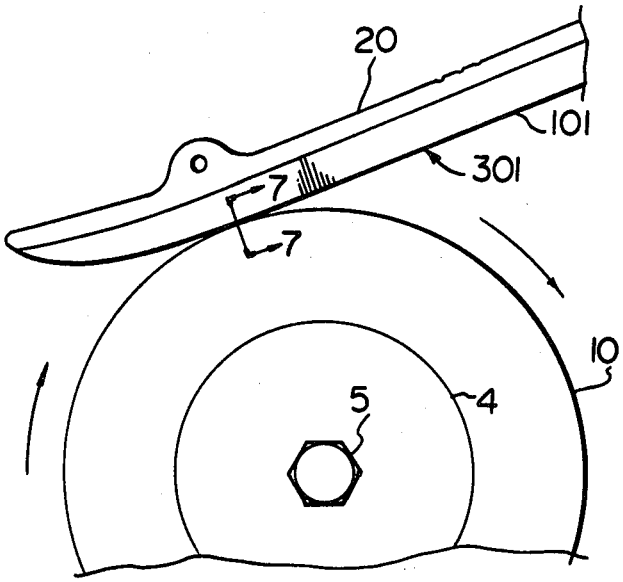
FIG. 6 illustrates the bottom surface of the skate blade of FIGS. 1 to 3 in the process of being shaped by a rotating circular grindstone.
Figure 7:
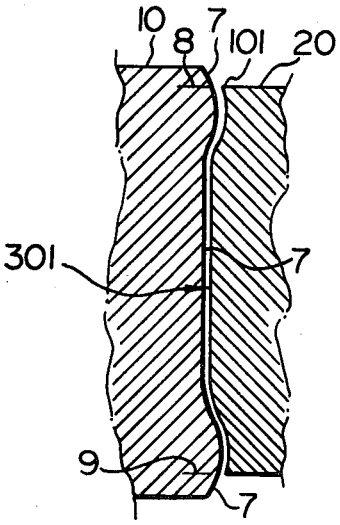
FIG. 7 is sectional view, partially cut-away, taken along section line 7—7 in FIG. 6.

As indicated above, a skate blade in accordance with the present invention may be manufactured with the use of a grindstone, the grinding edge of which is dressed with a profile oppositely corresponding to the desired bottom profile of the blade. By way of example, FIG. 6 illustrates blade 20 of FIG. 1 (partially cut-away) in the process of being ground by a grindstone 10 (also partially cut-away) rotating clockwise in a horizontal plane. Apart from the profile of its grinding edge 7, grindstone 10 is a conventional grindstone secured in a conventional manner to the rotor (not shown) of a rotative power means such as an electric motor (also not shown). Circular plates 4 (only one of which is shown) above and below the grindstone provide bracing and reinforcing support. Nut 5 secures the assembly to the rotor. FIG. 7 is a detail view taken along section line 7—7 in FIG. 6. For purposes of illustration, the blade and the grindstone have been separated a slight degree. As can be seen, the profile of grinding edge 7 between lines 8 and 9 is opposite to the bottom profile of blade 20 in transverse cross-section. It will be appreciated that blade 20 must be maintained at a fixed level and orientation relative to the grindstone as the blade is being ground in order to ensure that the desired profile is uniformly applied along the length of the bottom of the blade.

We claim:

1. An elongated skate blade for an ice skate, said blade comprising:

(a) a first acute-angled cutting edge formed longitudinally on one side of said blade for providing cutting engagement with an ice surface;

(b) a second acute-angled cutting edge formed longitudinally on the opposite side of said blade for providing cutting engagement with the ice surface; and, (c) a generally downwardly facing longitudinally extending bottom surface extending transversely from said first cutting edge to said second cutting edge, said bottom surface including:

(i) a first longitudinally extending edge face rising upwardly and inwardly from said first cutting edge;

(ii) a second longitudinally extending edge face rising upwardly and inwardly from said second cutting edge; and, (iii) a longitudinally extending middle face centrally disposed between said first and second edge faces and merging substantially smoothly therewith, said middle face having a substantially flat profile in transverse cross-section for at least one-third of the distance from the transverse centre of the blade to each side of the blade.

2. A skate blade as defined in claim 1, wherein said middle face has a substantially flat profile in transverse cross-section for at least one-half of the distance from the transverse centre of the blade to each side of the blade.

3. A skate blade as defined in claim 2, wherein said first and second edge faces have a downwardly concave profile in transverse cross-section.

4. A skate blade as defined in claim 1, 2, or 3, wherein said substantially flat profile is disposed above the level of said cutting edges.

5. A skate blade as defined in claim 1, 2 or 3, wherein said substantially flat profile is disposed approximately level with the level of said cutting edges.

6. A skate blade as defined in claim 1, 2 or 3, wherein said substantially flat profile is disposed below the level of said cutting edges.

7. An elongated skate blade for an ice skate, said blade comprising:

(a) a first acute-angled cutting edge formed longitudinally on one side of said blade for providing engagement with an ice surface;

(b) a second acute-angled cutting edge formed longitudinally on the opposite side of said blade for providing cutting engagement with the ice surface; and, (c) a generally downwardly facing longitudinally extending bottom surface extending transversely from said first cutting edge to said second cutting edge, said bottom surface including:

(i) a first longitudinally extending edge face rising upwardly and inwardly from said first cutting edge;

(ii) a second longitudinally extending edge face rising upwardly and inwardly from said second cutting edge; and, (iii) a longitudinally extending middle face centrally disposed between said first and second edge faces, said middle face having a downwardly convex profile in transverse cross-section, the radius of curvature of which profile exceeds the width of the blade at all points of the profile for at least one-third of the distance from the transverse centre of the blade to each side of the blade.

8. A skate blade as defined in claim 7, wherein the radius of curvature of said convex profile exceeds the width of the blade at all points of the profile for at least one-half of the distance from the transverse centre of the blade to each side of the blade.

9. A skate blade as defined in claim 8, wherein said first and second edge faces have a downwardly concave profile in transverse cross-section.

10. A skate blade as defined in claim 7, 8 or 9, wherein the middle face is disposed above the level of said cutting edges.

11. A skate blade as defined in claim 7, 8 or 9, wherein the lowermost part of said downwardly convex profile is disposed approximately level with the level of said cutting edges.

12. A skate blade as defined in claim 7, 8 or 9, wherein the lowermost part of said downwardly convex profile is disposed below the level of said cutting edges.

13. An elongated skate blade for an ice skate, said blade comprising:

(a) a first acute-angled cutting edge formed longitudinally on one side of said blade for providing cutting engagement with an ice surface when the blade is laterally tilted in one direction from an upright attitude on the ice surface;

(b) a second acute-angled cutting edge formed longitudinally on the opposite side of said blade for providing cutting engagement with the ice surface when the blade is laterally tilted in the opposite direction from said upright attitude; and, (c) a generally downwardly facing longitudinally extending bottom surface extending transversely from said first cutting edge to said second cutting edge, said bottom surface including:

(i) a first longitudinally extending edge face rising upwardly and inwardly from said first cutting edge;

(ii) a second longitudinally extending edge face rising upwardly and inwardly from said second cutting edge; and, (iii) a downwardly protruding longitudinally extending middle face centrally disposed between said first and second edge faces and merging substantially smoothly therewith, said middle face for providing sliding engagement with the ice surface having a transverse cross-sectional profile such that:

(A) the length of tangent lines extending transversely inwardly and downwardly from the first cutting edge to points of tangency with said middle face is not more than one-third of the width of the blade; and, (B) the length of tangent lines extending transversely inwardly and downwardly from the second cutting edge to points of tangency with said lower face is not more than one-third of the width of the blade.

14. A skate blade as defined in claim 13, wherein said first and second edge faces have a downwardly concave profile in transverse cross-section.

15. A skate blade as defined in claim 13 or 14, wherein said middle face has a downwardly convex profile in transverse cross-section.

16. A skate blade as defined in claim 13 or 14, wherein a central portion of said middle face has a substantially flat profile in transverse cross-section.

17. A skate blade as defined in claim 13 or 14, wherein the length of said tangent lines is not less than one-eighth and not more than one-quarter of the width of the blade.

18. A skate blade as defined in claim 14, wherein said middle face has a relatively wide longitudinally extending central portion extending transversely between first and second longitudinally extending shoulders of the middle face, the transverse cross-sectional profile of the middle face curving upwardly and outwardly relatively steeply at such shoulders.

19. A skate blade as defined in claim 18, wherein said central portion of the middle face has a convex profile in transverse cross-section.

20. A skate blade as defined in claim 18, wherein said central portion of the middle face has a substantially flat profile in transverse cross-section.

21. A skate blade as defined in claim 18, 19 or 20, wherein the length of said tangent lines is not less than one-eighth and not more than one-quarter of the width of the blade.

22. An elongated skate blade for an ice skate, said blade comprising:

(a) a first acute-angled cutting edge formed longitudinally on one side of said blade for providing cutting engagement with an ice surface when the blade is laterally tilted in one direction from an upright attitude on the ice surface;

(b) a second acute-angled cutting edge formed longitudinally on the opposite side of said blade for providing cutting engagement with the ice surface when the blade is laterally tilted in the opposite direction from said upright attitude; and, (c) a generally downwardly facing longitudinally extending bottom surface extending transversely from said first cutting edge to said second cutting edge, said bottom surface including:

(i) a first longitudinally extending edge face rising upwardly and inwardly from said first cutting edge;

(ii) a second longitudinally extending edge face rising upwardly and inwardly from said second cutting edge; and, (iii) a downwardly protruding longitudinally extending middle face centrally disposed between said first and second edge faces for providing sliding engagement with the ice surface, said middle face having a transverse cross-sectional profile such that:

(A) the length of tangent lines extending transversely inwardly and downwardly from the first cutting edge to points of tangency with said middle face is not more than one-third of the width of the blade; and, (B) the length of tangent lines extending transversely inwardly and downwardly from the second cutting edge to points of tangency with said lower face is not more than one-third of the width of the blade, wherein said tangent lines extend downwardly from said cutting edges at angles of not more than 20° relative to the horizontal when the blade is in said upright attitude.

23. A skate blade as defined in claim 22, wherein said first and second edge faces have a downwardly concave profile in transverse cross-section.

24. A skate blade as defined in claim 22 or 23, wherein a longitudinally extending central portion of said middle face has a downwardly convex profile in transverse cross-section, the radius of curvature of which profile generally increases with distance away from the transverse centre of the blade.

25. A skate blade as defined in claim 22 or 23, wherein a longitudinally extending central portion of the middle face has a substantially flat profile in transverse cross-section.

26. A skate blade as defined in claim 22 or 23, wherein the length of said tangent lines is not less than one-eighth and not more than one-quarter of the width of the blade.

27. A skate blade as defined in claim 22 or 23, wherein said tangent lines extend downwardly from said cutting edges at angles of not less than 1° and not more than 10° relative to the horizontal when the blade is in said upright attitude.

28. A skate blade as defined in claim 22 or 23, wherein:

(a) the length of said tangent lines is not less than one-eighth and not more than one-quarter of the width of the blade; and, (b) said tangent lines extend downwardly from said cutting edges at angles of not less than 1° and not more than 10° relative to the horizontal when the blade is in said upright attitude.

29. A skate blade as defined in claim 22, wherein said middle face has a relatively wide longitudinally extending central portion extending transversely between first and second longitudinally extending shoulders of the middle face, the transverse cross-sectional profile of the middle face curving upwardly and outwardly relatively steeply at such shoulders.

30. A skate blade as defined in claim 29, wherein said central portion of the middle face has a convex profile in transverse cross-section.

31. A skate blade as defined in claim 29, wherein said central portion of the middle face has a substantially flat profile in transverse cross-section.

32. A skate blade as defined in claim 29, 30 or 31, wherein the length of said tanget lines in not less than one-eighth and not more than one-quarter of the width of the blade.

33. A skate blade as defined in claim 29, 30 or 31, wherein said tangent lines extend downwardly from said cutting edges at angles of not less than 1° and not more than 10° relative to the horizontal when the blade is in said upright attitude.

34. A skate blade as defined in claim 29, 30 or 31, wherein:

(a) the length of said tangent lines is not less than one-eighth and not more than one-quarter of the width of the blade; and, (b) said tangent lines extend downwardly from said cutting edges at angles of not less than 1° and not more than 10° relative to the horizontal when the blade is in said upright attitude.

* * * * *